US007261378B2

(12) United States Patent
Dowty et al.

(10) Patent No.: US 7,261,378 B2
(45) Date of Patent: Aug. 28, 2007

(54) CAM LOCK FOR VEHICLE SEATING

(75) Inventors: Mark Brian Dowty, Rural Hall, NC (US); William Edward Haushalter, Spicewood, TX (US)

(73) Assignee: BE Aerospace, Inc., Welllington, FL (US)

( * ) Notice: Subject to any disclaimer, the term of this patent is extended or adjusted under 35 U.S.C. 154(b) by 340 days.

(21) Appl. No.: 11/048,604

(22) Filed: Feb. 1, 2005

(65) Prior Publication Data

US 2006/0170265 A1 Aug. 3, 2006

(51) Int. Cl.
*A47C 1/02* (2006.01)

(52) U.S. Cl. ..... 297/344.1; 297/344.11; 297/341; 297/375; 297/366; 188/38; 188/60

(58) Field of Classification Search ..... 297/344.1, 297/344.11, 341, 375, 374, 354.1, 366–368; 188/38, 60, 74; 248/412, 419; 49/172, 181, 49/176

See application file for complete search history.

(56) References Cited

U.S. PATENT DOCUMENTS

| | | | | |
|---|---|---|---|---|
| 2,341,465 | A * | 2/1944 | Monnot | 403/373 |
| 3,711,056 | A | 1/1973 | Gmeiner et al. | |
| 4,865,386 | A | 9/1989 | Detloff | |
| 5,127,192 | A * | 7/1992 | Cross | 49/181 |
| 5,169,238 | A * | 12/1992 | Schenk | 384/21 |
| 5,362,124 | A | 11/1994 | Schlidt | |
| 5,414,960 | A | 5/1995 | O'Donnell | |
| 5,695,247 | A | 12/1997 | Premji | |
| 5,826,934 | A | 10/1998 | Wooten | |
| 6,010,190 | A | 1/2000 | Downey | |
| 6,058,653 | A * | 5/2000 | Slocomb et al. | 49/181 |
| 6,155,640 | A * | 12/2000 | Severini | 297/344.1 |
| 6,279,995 | B1 | 8/2001 | Nakamura et al. | |
| 6,328,382 | B1 | 12/2001 | Yamashita | |
| 6,412,891 | B1 * | 7/2002 | Liang et al. | 312/334.44 |
| 6,502,903 | B2 | 1/2003 | Bruck | |
| 6,540,232 | B2 | 4/2003 | Hansel et al. | |
| 6,616,233 | B1 | 9/2003 | Debus et al. | |
| 6,659,558 | B2 | 12/2003 | Sugimoto | |
| 6,886,295 | B2 * | 5/2005 | Annes et al. | 49/181 |
| 6,915,609 | B2 * | 7/2005 | O'Donnell et al. | 49/181 |
| 7,083,243 | B2 * | 8/2006 | Lee | 312/333 |
| 2003/0121207 | A1 | 7/2003 | O'Donnell | |
| 2003/0145523 | A1 | 8/2003 | Annes et al. | |

FOREIGN PATENT DOCUMENTS

| | | |
|---|---|---|
| GB | 2 391 492 | 11/2004 |

* cited by examiner

*Primary Examiner*—Laurie K. Cranmer
(74) *Attorney, Agent, or Firm*—Adams Evans P.A.

(57) ABSTRACT

A locking apparatus for a moveable component of an aircraft seat. The locking apparatus includes a housing for being slidably received in a track, a first pair of opposed cams pivotally mounted in the housing, and a release member. The cams are moved between a lock position where the cams prevent the housing from sliding within the track and a release position. The release member is selectively moveable between a first position where the cams are maintained in the lock position and a second position where the cams are maintained in the release position.

18 Claims, 6 Drawing Sheets

CAM LOCK FOR VEHICLE SEATING

BACKGROUND OF THE INVENTION

This invention relates generally to vehicle seating and more particularly to a locking apparatus for a moveable component of an aircraft seat.

Seating units, particularly those in aircraft, are often provided with one or more components which are moveable so that a passenger seated therein can be comfortably supported in various positions. For example, the bottom of the seat may be translatable fore and aft. In order to provide the desired crash-worthiness, these moveable components must be securely locked in position when not actually being moved by the passenger. They must also be easy and convenient for the passenger to move when necessary, and they must withstand repeated and sometimes rough usage. Various prior art seats include electric motors or actuators to operate the moveable components, or pneumatic or hydraulic elements such as "hydrolocks". While these type of devices provide the desired adjustability, they are relatively complex and expensive compared to purely mechanical arrangements.

BRIEF SUMMARY OF THE INVENTION

Therefore, it is an object of the invention to provide a locking apparatus for a moveable portion of a passenger seat which allows the seat to be selectively locked in a desired position.

It is another object of the invention to provide a locking apparatus that has an infinite number of locking positions.

It is another object of the invention to provide a locking apparatus that is mechanical in operation.

It is another object of the invention to provide a locking apparatus that is inexpensive to manufacture.

These and other objects of the present invention are achieved in the preferred embodiments disclosed below by providing a locking apparatus including a housing for being slidably received in a track; a first pair of opposed cams pivotally mounted in the housing, the cams being moveable between a lock position and a release position, wherein the cams prevent the housing from sliding within the track when in the lock position; and a release member selectively positionable from a first position where the cams are maintained in the lock position and a second position where the cams are maintained in the release position.

According to another preferred embodiment of the invention, the locking apparatus further includes a second pair of opposed cams pivotally mounted in the housing.

According to another preferred embodiment of the invention, the first pair of opposed cams and the second pair of opposed cams have offset pivot points for creating a progressive lobe for each respective cam.

According to another preferred embodiment of the invention, the first pair of opposed cams and the second pair of opposed cams are connected by a spring.

According to another preferred embodiment of the invention, the release member has an end having a length greater than its width.

According to another preferred embodiment of the invention, the first pair of opposed cams have offset pivot points for creating a progressive lobe for each respective cam.

According to another preferred embodiment of the invention, at least one roller is carried by the housing for permitting the housing to slide within the track.

According to another preferred embodiment of the invention, the first pair of opposed cams are mounted in a recess of the housing.

According to another preferred embodiment of the invention, the first pair of cams protrude from the housing when in the lock position to engage and prevent the housing from sliding within the track.

According to another preferred embodiment of the invention, a reclining seat includes a track fixedly attached to a frame; a seat pan assembly mounted for sliding movement within the track; and a locking apparatus fixedly attached to the seat pan assembly. The locking apparatus includes a housing for being slidably received in the track; a first pair of opposed cams pivotally mounted in the housing, the cams being moveable between a lock position and a release position, wherein the cams prevent the housing from sliding within the track when in the lock position; and a release member selectively moveable from a first position where the cams are maintained in the lock position and a second position where the cams are maintained in the release position.

According to another preferred embodiment of the invention, the seat pan assembly includes a pair of spaced-apart, longitudinally-extending rails connected by a plurality of cross-members.

According to another preferred embodiment of the invention, the locking apparatus is positioned on an outside surface of each of the respective rails at a rear end of each rail.

According to another preferred embodiment of the invention, each of the rails includes a roller for being received in a track.

According to another preferred embodiment of the invention, the reclining seat further includes a seat back pivotally mounted to the seat pan assembly.

BRIEF DESCRIPTION OF THE DRAWINGS

The subject matter that is regarded as the invention may be best understood by reference to the following description taken in conjunction with the accompanying drawing figures in which.

DETAILED DESCRIPTION OF THE INVENTION

Figure 1:
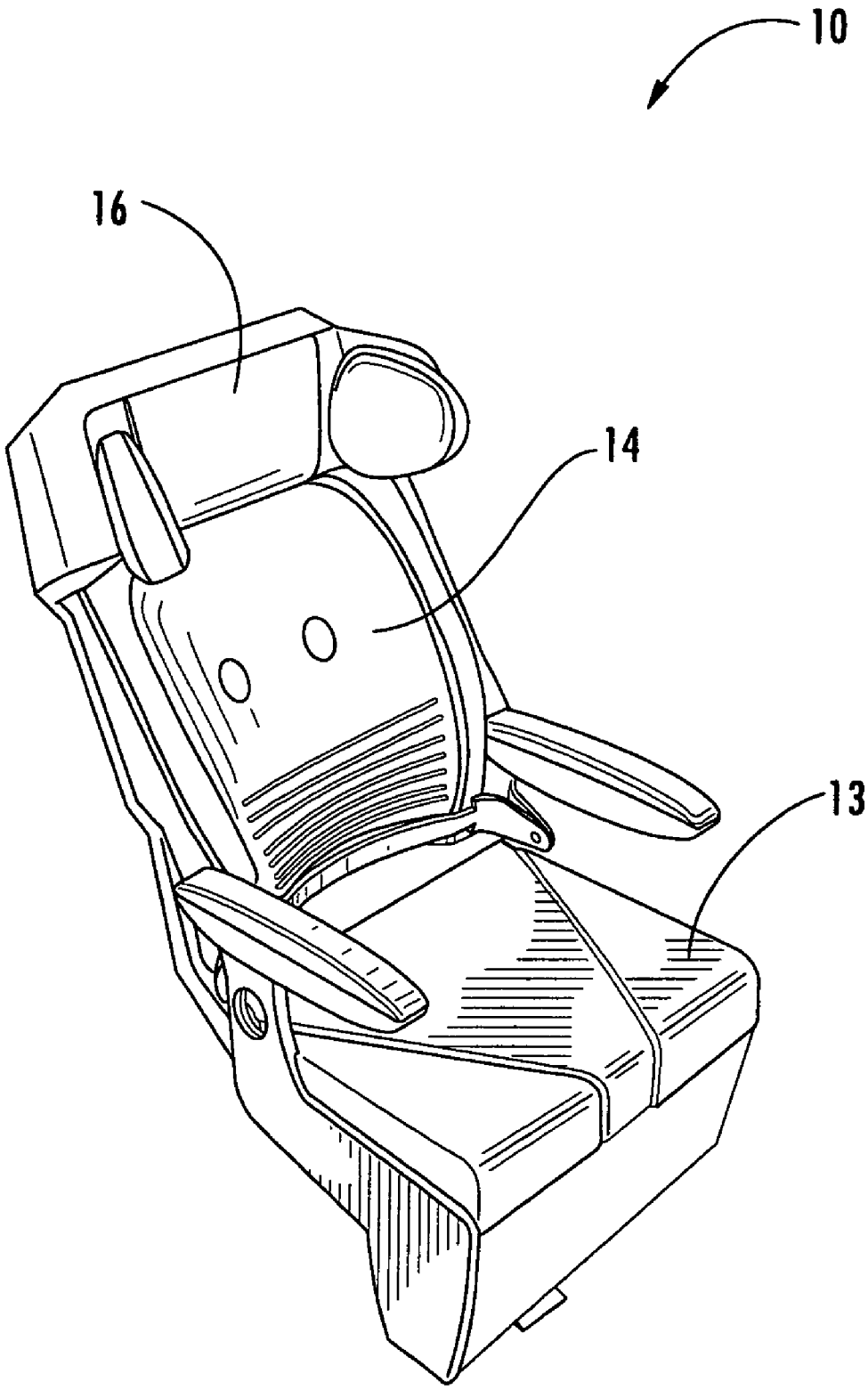
FIG. 1 is a perspective view of a passenger seat including a moveable seat pan assembly.
Figure 2:
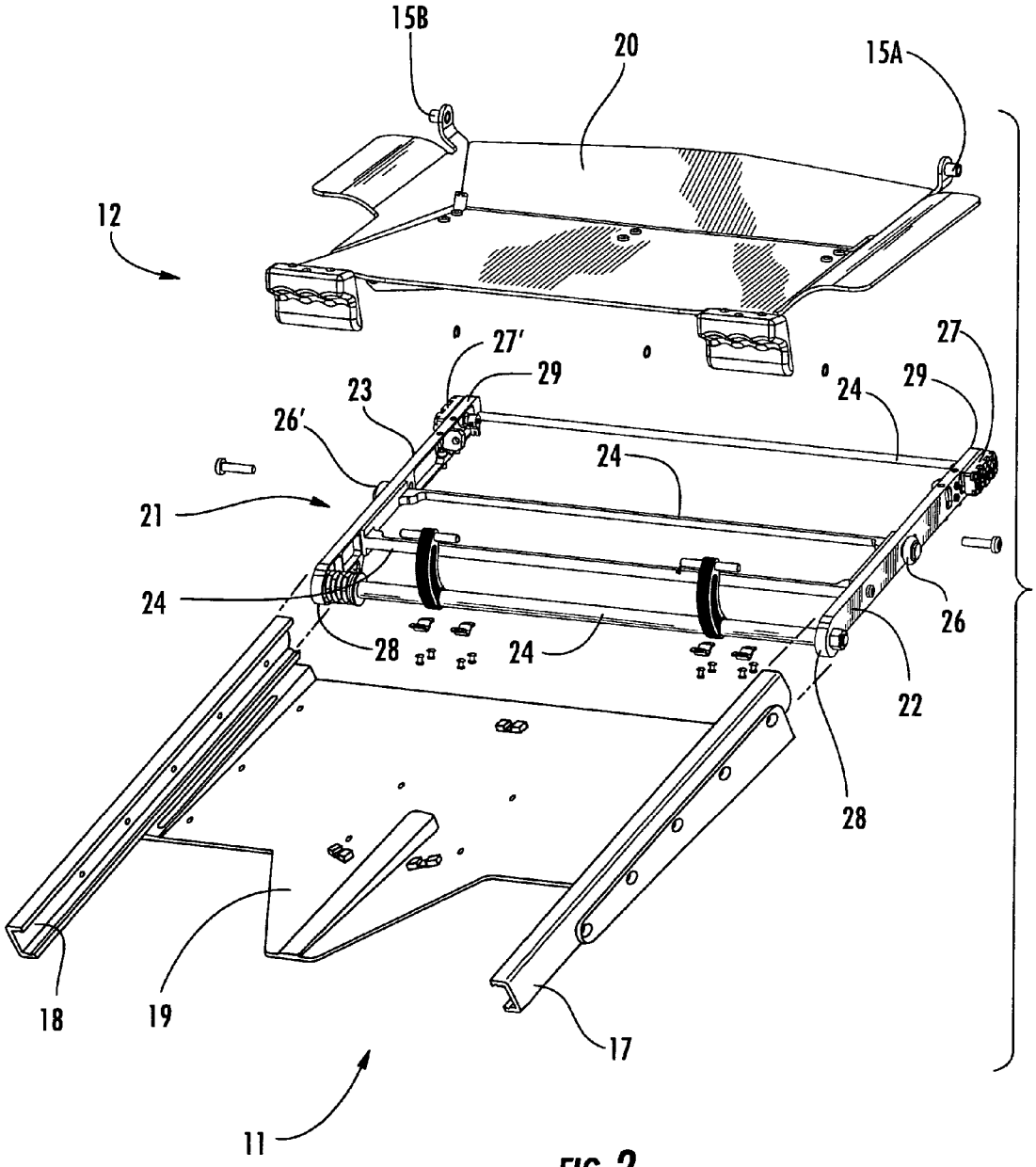
FIG. 2 is an exploded view of the seat pan assembly of FIG. 1.
Figure 3:
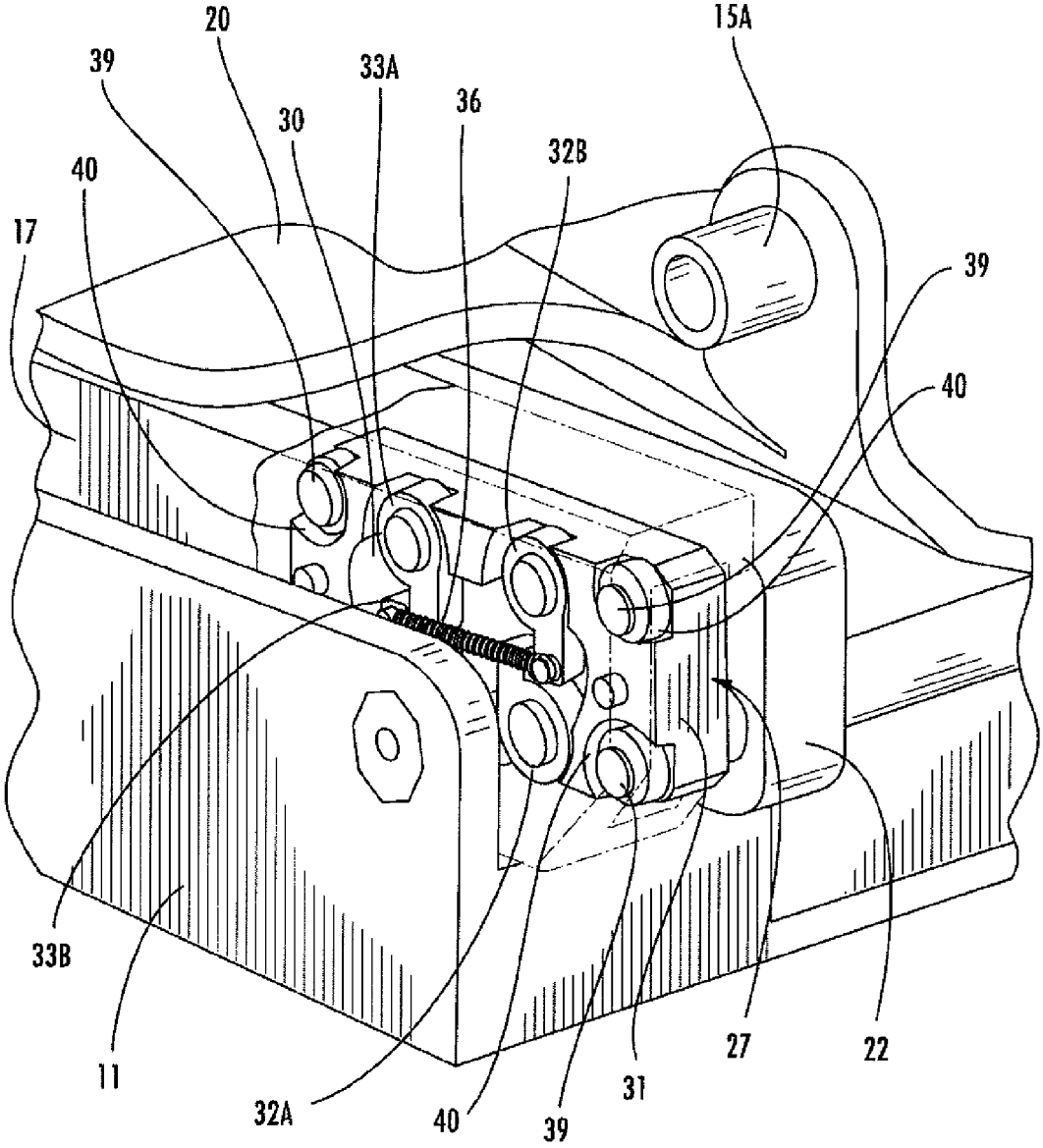
FIG. 3 is a perspective view of a locking apparatus attached to a seat pan assembly and positioned within a track.

Referring now specifically to the drawings, an exemplary passenger seat constructed according to an embodiment of the present invention is illustrated in FIGS. 1-3 and shown generally at reference numeral 10. The seat 10 has a seat frame 11 for being attached to the deck of an aircraft (a portion of which is shown in FIG. 2) and includes a seat pan assembly 12 slidably attached to the seat frame 11, a seat bottom 13, a seat back 14 pivotally attached to a pair of pivots 15A and 15B of the seat pan assembly 12, and a headrest 16. The seat frame 11 includes two spaced-apart, longitudinal, inward-facing C-shaped tracks 17 and 18 connected by a plate 19. The seat pan assembly 12 includes a seat pan 20 attached to a seat pan frame assembly 21 which includes a pair of spaced-apart rails 22 and 23 connected by a plurality of cross-members 24. Rollers 26 and 26' and a locking apparatuses 27 and 27' are positioned on an outside surface of the rails 22 and 23 respectively, and are sized to fit in the C-shaped tracks 17 and 18, as shown in FIG. 3, to allow the seat pan assembly 12 to slide therein. In the illustrated example, the rollers 26 and 26' are positioned approximately midway between a first end 28 and a second end 29 of the respective rails 22 and 23 and the locking apparatuses 27 and 27' are positioned at the second end 29 of each rail 22 and 23.

Figure 4:
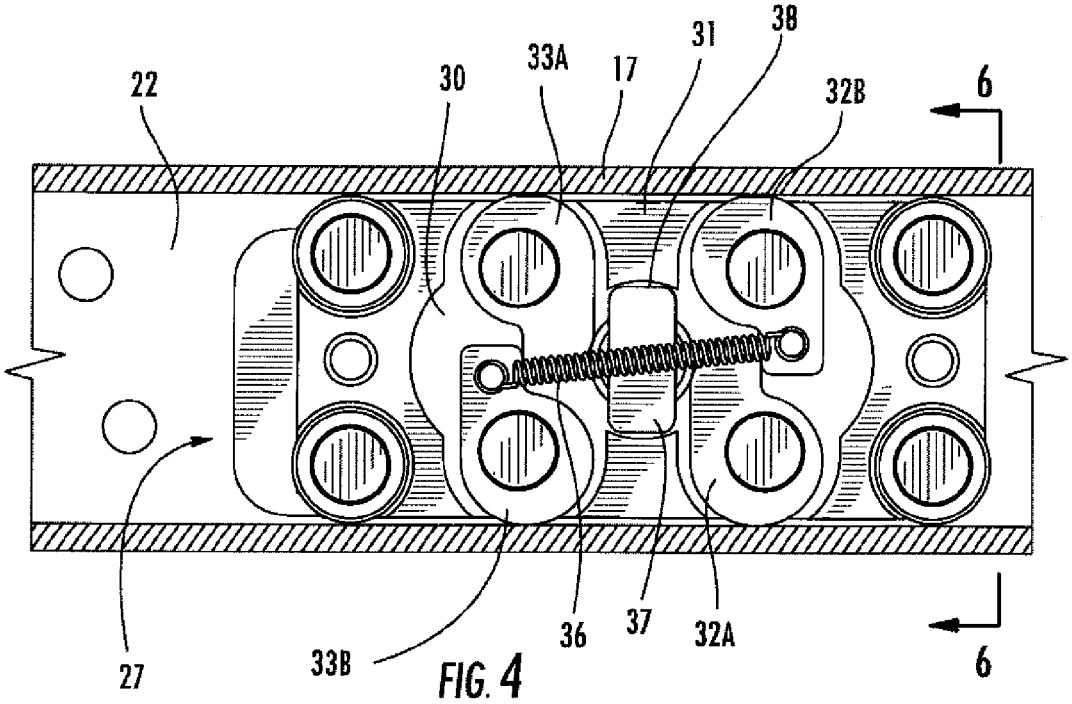
FIG. 4 is a plan view of an exemplary locking apparatus disposed within a track in a locked position.
Figure 5:
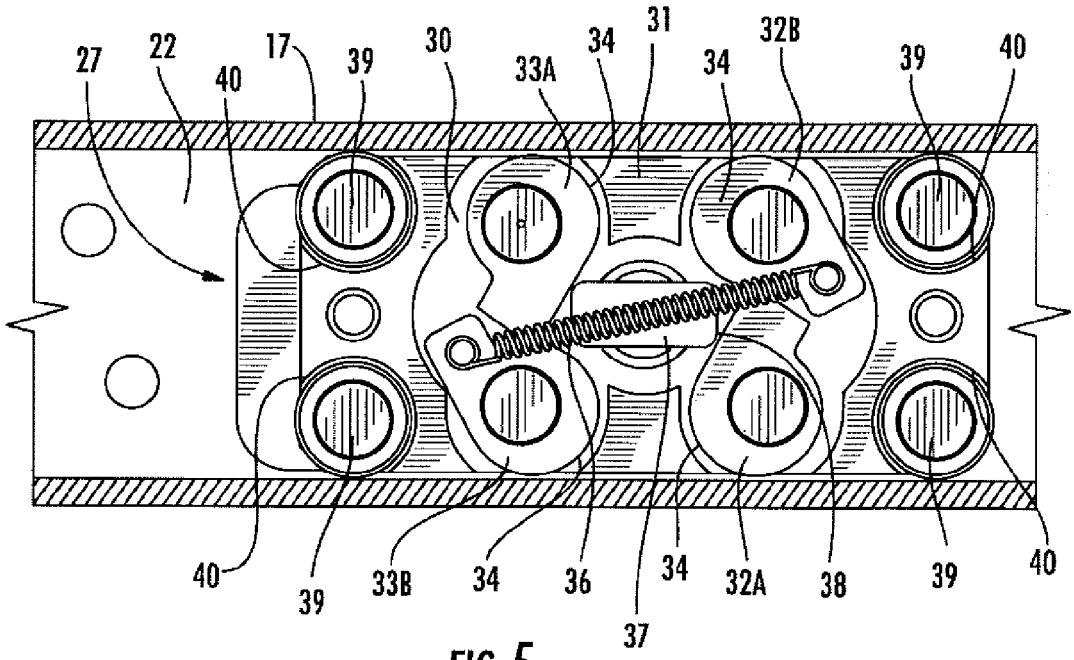
FIG. 5 is a plan view of the locking apparatus of FIG. 4 in a released position.
Figure 6:
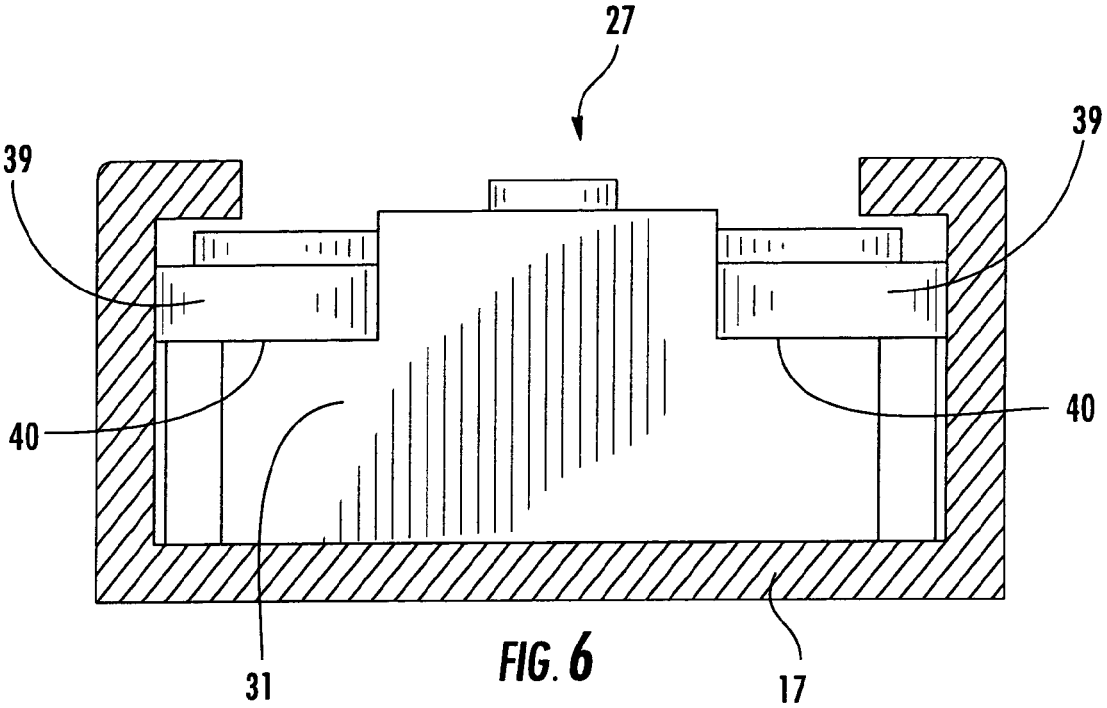
FIG. 6 is an end view of the locking apparatus of FIG. 4.

The locking apparatuses 27 and 27' are substantially identical in construction, therefore, only the locking apparatus 27 will be described in detail. As illustrated in FIGS. 4-6, the locking apparatus 27 includes two pairs of opposing cams positioned within a recess 30 of a housing 31, each pair having an inner cam 32A, 33A and an outer cam 32B, 33B pivotally attached to the housing 31. The pivot point for each cam 32A, 32B, 33A, and 33B is offset to create a progressive lobe 34 for each cam which increases pressure on the tracks 17 and 18 when sliding loads are applied. The outer cams 32B and 33B are connected by a spring 36 or other suitable structure which pulls the outer cams 32B and 33B towards the inner cams 32A and 33A, engaging and forcing the inner cams 32A and 33A against a release member 37 located in the center of the housing 31. The release member 37 includes a non-circular end 38 having a length greater than its width. As illustrated, the end 38 is rectangular. In the illustrated example, a roller 39 is positioned within a recess 40 located at each corner of the housing 31 and extends slightly past an outside edge of the housing 31, allowing the locking apparatus 27 to slide easily within the track 17.

In the locked position, the cams 32A, 32B, 33A, and 33B engage an inside surface of the track 17 to prevent the locking apparatus 27 from sliding, thereby preventing the seat pan assembly 12 from translating fore or aft with respect to the frame 11. The cams 32A, 32B, 33A, and 33B are placed into a locked position by turning the release member 37 so that the end 38 is generally perpendicular to the track 17. The spring 36 forces the cams 32A, 32B, 33A, and 33B to pivot towards the center of the housing 31 by pulling the outer cams 32B and 33B towards each other, forcing the outer cams 32B and 33B to engage the inner cams 32A and 33A, thereby moving the lobes 34 past the outside edge of the housing 31 and against the inside surface of the track 17. As shown, cams 32A and 32B prevent movement in the forward direction and cams 33A and 33B prevent movement in the aft direction.

To release the locking apparatus 27, the release member 37 is turned so that the end 38 is generally parallel with the track 17. The release member 37 forces the inner cams 32A and 33A against the outer cams 32B and 33B, forcing both pairs of cams 32A, 32B and 33A, 33B away from the center of the housing 31 against the spring 36, and thereby disengaging the cams 32A, 32B, 33A, and 33B from the inner surface of the track 17 and allowing the seat pan assembly 12 to translate freely between fore and aft positions.

The cams 32A, 32B, 33A, and 33B may also be turned around so that the progressive lobes 34 face inward towards the center of the housing 31, allowing the lobes to bear against a rod, bar, tube or other member passing through the center of the locking apparatus 27.

In operation, the seat 10 is reclined by turning the release member 37 to the release position as described above, allowing the seat pan assembly 12 to translate fore and aft with respect to the seat frame 11. Any means which allows the passenger to turn the release member 37 may be used. For example, a cable may be attached between a passenger-operable lever or button and the release member 37, or a button may be positioned on an armrest and operably connected to a motor or hydraulic actuator for turning the release member 37.

The fore and aft movement of the seat pan assembly 12 causes the seat back 14 to move between an upright and recline position. Once a desired recline position has been determined, the seat 10 is locked in position by turning the release member 37, as discussed above, to the lock position, allowing the cams 32A, 32B, 33A, 33B to engage the track 17. Unlike prior art devices that use notches or slots, the locking apparatus 27 allows for infinite adjustment, since the cams 32A, 32B, 33A, and 33B are designed to engage a flat surface and do not require dimples, notches, slots, or any other type of depression to lock the seat pan assembly 12 in position.

Figure 7:
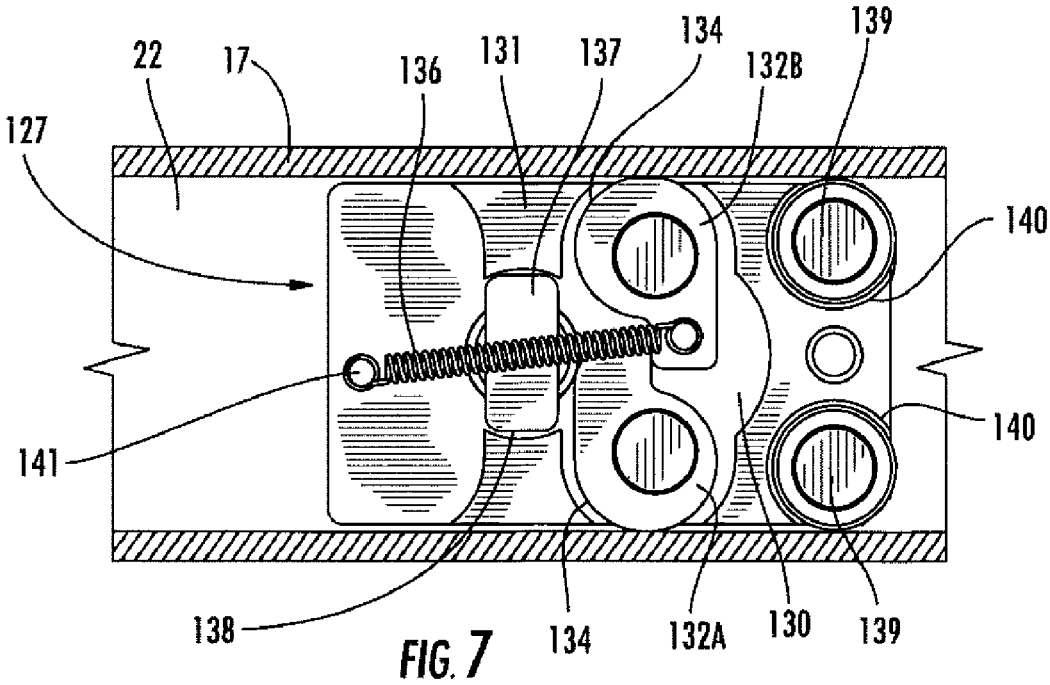
FIG. 7 is a plan view of an alternative locking apparatus disposed within a track in a locked position.
Figure 8:
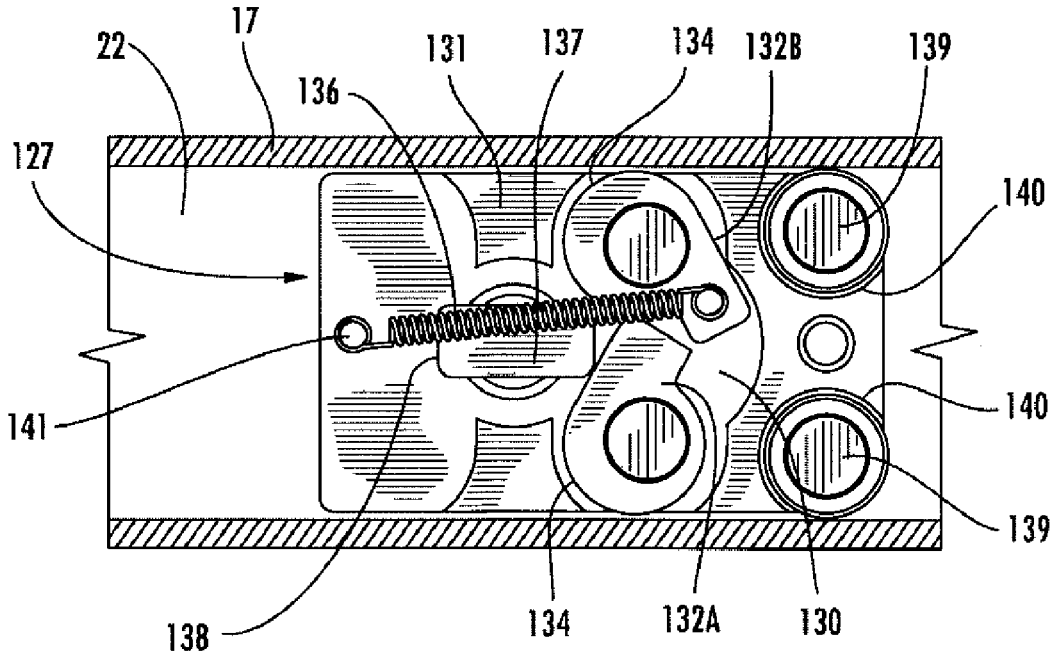
FIG. 8 is a plan view of the locking apparatus of FIG. 7.

Referring now to FIGS. 7 and 8, in an alternate embodiment of the invention, a locking apparatus 127 includes one pair of opposing cams positioned within a recess 130 of a housing 131, the pair having an inner cam 132A and an outer cam 132B pivotally attached to the housing 131. The pivot point for each cam 132A and 132B is offset to create a progressive lobe 134 for each cam. The outer cam 132B is connected to a post 141 by a spring 136 or other suitable structure which pulls the outer cam 132B towards the inner cam 132A, forcing the inner cam 132A against a release member 137 located in the center of the housing 131. The release member 137 includes a non-circular end 138 having a length greater than its width. As illustrated, the end 138 is rectangular. In the illustrated example, a roller 139 is positioned within a recess 140 located at each of the two aft corners of the housing 131 and extends slightly past an outside edge of the housing 131, allowing the locking apparatus 127 to slide easily within the track 17.

In the locked position, the locking apparatus 127 only prevents the seat pan assembly from translating in the fore direction, allowing the seat pan assembly to freely move in the aft direction. In this embodiment, the cams 132A and 132B engage an inside surface of the track 17 to prevent the locking apparatus 127 from sliding, thereby preventing the seat pan assembly 12 from moving fore with respect to the frame 11. The cams 132A and 132B are forced into a locked position by turning the release member 137 so that the end 138 is generally perpendicular to the track 17. The spring 136 forces the cams 132A and 132B to pivot towards the center of the housing 131 by pulling the outer cam 132B towards the center of the housing 131, forcing the outer cam 132B to engage the inner cam 132A, thereby forcing the lobes 134 past the outside edge of the housing 131 and against the inside surface of the track 17.

To release the locking apparatus 27, the release member 137 is turned so that the end 138 is generally parallel with the track 17. The release member 137 forces the inner cam 132A against the outer cam 132B, forcing the cams 132A and 132B away from the center of the housing 131 against the spring 36, and thereby disengaging the cams 132A and 132B from the inner surface of the track 17.

The foregoing has described a locking apparatus for a vehicle seat. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation, the invention being defined by the claims.

We claim:

1. A locking apparatus, comprising:

(a) a housing for being slidably received in a track;

(b) a first pair of opposed cams pivotally mounted in the housing, the cams being moveable between a lock position and a release position, wherein the cams prevent the housing from sliding within the track when in the lock position;

(c) a second pair of opposed cams pivotally mounted in the housing; and (d) a release member selectively moveable from a first position where at least the first pair of opposed cams are maintained in the lock position and a second position where at least the first pair of opposed cams are maintained in the release position.

2. The locking apparatus according to claim 1, wherein each of the second pair of opposed cams has a pivot point that is offset from the center of the cam for creating a progressive lobe for each respective cam.

3. The locking apparatus according to claim 1, wherein one of the first pair of opposed cams is connected to one of the second pair of opposed cams by a spring.

4. The locking apparatus according to claim 1, wherein each of the first pair of opposed cams has a pivot point that is offset from the center of the cam for creating a progressive lobe for each respective cam.

5. A locking apparatus, comprising:

(a) a housing for being slidably received in a track;

(b) a pair of opposed cams pivotally mounted in the housing, the cams being moveable between a lock position and a release position, wherein the cams prevent the housing from sliding within the track when in the lock position;

(c) a release member selectively moveable from a first position where the pair of cams are maintained in the lock position and a second position where the pair of cams are maintained in the release position; and (d) at least one roller carried by the housing for permitting the housing to slide within the track.

6. The locking apparatus according to claim 1, wherein the first pair of opposed cams are mounted in a recess of the housing.

7. The locking apparatus according to claim 1, wherein the first pair of cams protrude from the housing when in the lock position to engage the track and thereby prevent the housing from sliding within the track.

8. A reclining seat, comprising:

(a) a track fixedly attached to a frame;

(b) a seat pan assembly mounted for sliding movement within the track; and (c) a locking apparatus fixedly attached to the seat pan assembly, the locking apparatus comprising:

(i) a housing for being slidably received in the track;

(ii) a first pair of opposed cams pivotally mounted in the housing, the cams being moveable between a lock position and a release position, wherein the cams prevent the housing from sliding within the track when in the lock position; and (iii) a release member selectively moveable from a first position where the cams are maintained in the lock position and a second position where the cams are maintained in the release position.

9. The reclining seat according to claim 8, and further comprising a second pair of opposed cams pivotally mounted in the housing.

10. The reclining seat according to claim 9, wherein each of the first pair of opposed cams and each of the second pair of opposed cams has a pivot point that is offset from the center of the cam for creating a progressive lobe for each respective cam.

11. The reclining seat according to claim 8, wherein the seat pan assembly includes a pair of spaced-apart, longitudinally-extending rails connected by a plurality of cross-members.

12. The reclining seat according to claim 11, wherein the locking apparatus is positioned on an outside surface of each of the respective rails at a rear end of each rail.

13. The reclining seat according to claim 11, wherein each of the rails includes a roller for being received in the track.

14. The reclining seat according to claim 8, and further including a seat back pivotally mounted to the seat pan assembly.

15. The reclining seat according to claim 8, wherein each of the first pair of opposed cams has a pivot point that is offset from the center of the cam for creating a progressive lobe for each respective cam.

16. The reclining seat according to claim 8, wherein at least one roller is carried by the housing.

17. The reclining seat according to claim 8, wherein the first pair of cams are mounted in a recess of the housing.

18. The reclining seat according to claim 8, wherein the first pair of cams protrude from the housing when in the lock position to engage the track and thereby prevent the housing from sliding within the track.

* * * * *